US005783373A

United States Patent [19]

Mydlarz et al.

[11] Patent Number: 5,783,373

[45] Date of Patent: Jul. 21, 1998

[54] DIGITAL IMAGING WITH HIGH CHLORIDE EMULSIONS

[75] Inventors: Jerzy Z. Mydlarz; Jerzy A. Budz, both of Fairport; Eric L. Bell, Webster, all of N.Y.

[73] Assignee: Eastman Kodak Company, Rochester, N.Y.

[21] Appl. No.: 740,535

[22] Filed: Oct. 30, 1996

[51] Int. Cl.[6] ..... G03C 1/09; G03C 1/035

[52] U.S. Cl. ..... 430/363; 430/604; 430/605; 430/567

[58] Field of Search ..... 430/604, 605, 430/567, 363, 945

[56] References Cited

U.S. PATENT DOCUMENTS

| | | | |
|---|---|---|---|
| 4,713,323 | 12/1987 | Maskasky | 430/569 |
| 4,933,272 | 6/1990 | McDugle et al. | 430/567 |
| 4,945,035 | 7/1990 | Keevert, Jr. et al. | 430/567 |
| 5,126,235 | 6/1992 | Hioki | 430/505 |
| 5,252,451 | 10/1993 | Bell | 430/567 |
| 5,256,530 | 10/1993 | Bell | 430/567 |
| 5,320,938 | 6/1994 | House et al. | 430/567 |
| 5,385,817 | 1/1995 | Bell | 430/567 |
| 5,418,118 | 5/1995 | Edwards et al. | 430/506 |
| 5,451,490 | 9/1995 | Budz et al. | 430/363 |
| 5,474,888 | 12/1995 | Bell | 430/567 |
| 5,480,771 | 1/1996 | Bell | 430/567 |
| 5,500,335 | 3/1996 | Bell | 430/567 |
| 5,547,827 | 8/1996 | Chen et al. | 430/567 |

FOREIGN PATENT DOCUMENTS

| | | | |
|---|---|---|---|
| 0 479 167 A1 | 4/1992 | European Pat. Off. | G03C 8/40 |
| 0 502 508 A1 | 9/1992 | European Pat. Off. | G03C 8/08 |

OTHER PUBLICATIONS

Research Disclosure, Item 38957, I, D.

Research Disclosure, vol. 389, Sep., 1996, Item 38957, II, A.

Hunt, "The Reproduction of Colour", Fourth Edition, pp. 306–307 (1987).

*Primary Examiner*—Mark F. Huff

*Attorney, Agent, or Firm*—Carl O. Thomas

[57] ABSTRACT

An electronic printing method is disclosed which comprises subjecting a radiation sensitive silver halide emulsion layer of a recording element to actinic radiation of at least $10^{-4}$ ergs/cm$^2$ for up to 100μ seconds duration in a pixel-by-pixel mode. The silver halide emulsion layer is comprised of grains predominantly bounded by {100} crystal faces and internally containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) a iridium coordination complex having ligands each of which are more electropositive than a cyano ligand. A gelatino-peptizer for the grains is employed that contains less than 30 micromoles of methionine per gram. The dopants and peptizer in combination increase contrast and provide a highly unexpected increase in high density contrast.

29 Claims, No Drawings

DIGITAL IMAGING WITH HIGH CHLORIDE EMULSIONS

FIELD OF THE INVENTION

The invention relates to a method of electronic printing wherein information is recorded in a pixel-by-pixel mode in a radiation silver halide emulsion layer.

DEFINITION OF TERMS

The term "high chloride" in referring to silver halide grains and emulsions indicates that chloride is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

The term "central portion" in referring to silver halide grains refers to that portion of the grain structure that is first precipitated accounting for up to 98 percent of total precipitated silver required to form the {100} crystal faces of the grains.

The term "dopant" is employed to indicate any material within the rock salt face centered cubic crystal lattice structure of the central portion of a silver halide grain other than silver ion or halide ion.

The term "surface modifier" refers to any material other than silver ion or halide ion that is associated with a portion of the silver halide grains other than the central portion.

The term "gelatino-peptizer" is employed to designate a gelatin peptizer or a peptizer derived from gelatin, such as acetylated or phthalated gelatin.

The term "low methionine" in referring to gelatino-peptizers indicates a methionine level of less than 30 micromoles per gram.

The term "tabular grain" indicates a grain having two parallel major crystal faces (face which are clearly larger than any remaining crystal face) and having an aspect ratio of at least 2.

The term "aspect ratio" designates the ratio of the average edge length of a major face to grain thickness.

The term "tabular grain emulsion" refers to an emulsion in which tabular grains account for greater than 50 percent of total grain projected area.

The term "{100} tabular" is employed in referring to tabular grains and tabular grain emulsions in which the tabular grains have {100} major faces.

The term "log E" is the logarithm of exposure in lux-seconds.

Speed is reported as relative log speed, where 1.0 relative log speed unit is equal to 0.01 log E.

The term "contrast" or "$\gamma$" is employed to indicate the slope of a line drawn from stated density points on the characteristic curve.

*Research Disclosure* is published by Kenneth Mason Publications, Ltd., Dudley House, 12 North St., Emsworth, Hampshire P010 7DQ, England.

BACKGROUND

Many known imaging systems require that a hard copy be provided from an image which is in digital form. A typical example of such a system is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source, such as a light emitting diode (LED) or laser. A cathode ray tube (CRT) is also sometimes used as a printer light source in some devices. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Budz et al U.S. Pat. No. 5,451,490 discloses an improved electronic printing method which comprises subjecting a radiation sensitive silver halide emulsion layer of a recording element to actinic radiation of at least $10^{-4}$ ergs/cm$^2$ for up to 100μ seconds duration in a pixel-by-pixel mode. The radiation sensitive silver halide emulsion layer contains a silver halide grain population comprising at least 50 mole percent chloride, based on silver, forming the grain population projected area. At least 50 percent of the grain population projected area is accounted for by tabular grains that are bounded by {100} major faces having adjacent edge ratios of less than 10, each having an aspect ratio of at least 2. The substitution of a high chloride tabular grain emulsion for a high chloride cubic grain emulsion was demonstrated to reduce high intensity reciprocity failure (HIRF). Budz et al discloses among conventional alternatives (a) dopants and (b) low methionine gelatino-peptizer among conventional alternatives. Budz et al in Example 3 discloses a silver iodochloride {100 } tabular grain emulsion prepared in the presence of a low methionine gelatino-peptizer and ruthenium hexachloride.

Maskasky U.S. Pat. No. 4,713,323 employed a low methionine gelatino-peptizer in the preparation of high chloride {111 } tabular grain emulsions to reduce tabular grain thickness and eliminate any necessity of employing a synthetic peptizer. House et al U.S. Pat. No. 5,320,938 taught the use of a low methionine gelatino-peptizer as an option in the preparation of high chloride {100} tabular grain emulsions. Treatment of gelatino-peptizer with an oxidizing agent to lower methionine is disclosed by *Research Disclosure*, Vol. 389, September 1996, Item 38957, II. Vehicles, vehicle extenders, vehicle-like addenda and vehicle related addenda, A. Gelatin and hydrophilic colloid peptizers, paragraph (3).

The use of dopants in silver halide grains to modify photographic performance is generally illustrated by *Research Disclosure*, Item 38957, cited above, I. Emulsion grains and their preparation, D. Grain modifying conditions and adjustments, paragraphs (3)–(5). McDugal et al U.S. Pat. No. 4,933,272 was the first to teach the incorporation of hexacoordination complexes containing a transition metal and a nitrosyl or thionitrosyl ligand as a dopant in silver halide grains. Keevert et al U.S. Pat. No. 4,945,035 was the first to teach the incorporation of a hexacoordination complex containing a transition metal and cyano ligands as a dopant in high chloride grains. Maskasky, cited above, which preceded McDugal et al and Keevert et al, and House et al, cited above, which followed McDugal et al and Keevert et al, both contemplated the inclusion of conventional dopants, although no investigations of dopants are reported.

Bell U.S. Pat. Nos. 5,252,451, 5,256,530, 5,385,817, 5,474,888, 5,480,771 and 5,500,335, hereinafter collectively referred to as Bell, investigated the effects of varied combinations of grain dopants and surface modifiers. The reported combinations are summarized in Table I.

TABLE I

| Patent | Surface Modifier | Surface Modifier | Dopant | Dopant |
|---|---|---|---|---|
| '451 | Os(NO)[1] | | M(CN)[2] | |
| '530 | Os(NO) | M(CN) | | |
| '817 | M(CN) | Os(NO) | | |
| '888 | Os(NO) | | M(CN) | Ir[3] |
| '771 | M(CN) | | Os(NO) | Ir |
| '335 | Os(NO) | M(CN) | | Ir |

[1] $Os(NO)Cl_5$
[2] $Fe(CN)_6$ or $Ru(CN)_6$
[3] $Ir(Cl)_6$

What becomes quite clear from the various combinations of Bell is that including all of Os(NO), M(CN) and Ir as dopants was avoided. Bell specifically notes that previous combinations of dopants have been ineffective. As a result, in using these three materials in combination, at least one of the materials was located at the surface of the grains and subject to displacement or competition from other addenda present at the surfaces of the grains.

Edwards et al U.S. Pat. No. 5,418,118 teaches color paper constructions in which instantaneous contrast progressively increases in going from areas of minimum density to areas of maximum density, so that increased detail in shadow areas can be seen.

RELATED PATENT APPLICATIONS

McIntyre et al U.S. Pat. No. 5,597,686, titled PHOTOGRAPHIC SILVER HALIDE CONTAINING CONTRAST IMPROVING DOPANTS, discloses employing Os(NO) and M(CN) dopants in combination to improve contrast by sharpening the toe of the characteristic curve and increasing $\gamma$, where $\gamma$ is measured as the slope of the characteristic curve measure from 0.3 log E short of the speed point to 0.3 log E beyond the speed point, the speed point being taken at a density of 1.0. It is suggested, but not demonstrated, that a third transition metal can be added as a dopant or as a grain growth modifier "without significantly detracting from effects of the other emulsion dopants". In other words, there is no indication that the optional, third transition metal plays any role in obtaining the advantages described. McIntyre et al contains no teaching or suggestion of low methionine gelatino-peptizers.

Mydlarz et al U.S. Ser. No. 08/739,980 filed concurrently herewith and commonly assigned, titled A HIGH CHLORIDE EMULSION THAT CONTAINS A DOPANT AND PEPTIZER COMBINATION THAT INCREASES HIGH DENSITY CONTRAST, discloses a radiation-sensitive high chloride emulsion comprised of grains predominantly bounded by {100} crystal faces and internally containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands each of which are more electropositive than a cyano ligand. A gelatino-peptizer for the grains is employed that contains less than 30 micromoles of methionine per gram. The dopants and peptizer in combination increase contrast and provide a highly unexpected increase in high density contrast.

SUMMARY OF THE INVENTION

In one aspect this invention is directed to an electronic printing method which comprises subjecting a radiation sensitive silver halide emulsion layer of a recording element to actinic radiation of at least $10^{-4}$ ergs/cm$^2$ for up to 100μ seconds duration in a pixel-by-pixel mode, wherein the silver halide emulsion layer is comprised of (1) silver halide grains (a) containing greater than 50 mole percent chloride, based on silver, (b) having greater than 50 percent of their surface area provided by {100} crystal faces, and (c) having a central portion accounting for from 95 to 98 percent of total silver and containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands which are more electropositive than a cyano ligand, and (2) a gelatino-peptizer for the silver halide grains that contains less than 30 micromoles of methionine per gram.

It has been discovered quite surprisingly that the combination of dopants (i), (ii) and (iii) in further combination with a low methionine gelatino-peptizer provides higher contrast than can be achieved with any one dopant or any combination of two dopants used in combination with either low methionine gelatino-peptizer or gelatino-peptizer having higher levels of methionine. Further, surprisingly, the combination of dopants (i), (ii) and (iii) achieve these increased levels of contrast only when a low methionine gelatino-peptizer is employed. It has not been reported or suggested prior to this invention that the methionine content of a gelatino-peptizer plays any significant role in increasing contrast, particularly for high intensity and short duration exposures. In a preferred practical application this can be transformed into increased throughput of digital artifact-free color print images while exposing each pixel sequentially in synchronism with the digital data from an image processor.

Furthermore the invention offers the advantage of placing (i), (ii) and (iii) within the central portion of the grains, thereby protecting these materials from competing and/or antagonistic effects that can occur at the surface of the grains as a result of chemical and spectral sensitization and the addition of other absorbed addenda.

DESCRIPTION OF PREFERRED EMBODIMENTS

The present invention represents an improvement on the electronic printing method disclosed by Budz et al, cited above and here incorporated by reference. Specifically, this invention is directed to an electronic printing method which comprises subjecting a radiation sensitive silver halide emulsion layer of a recording element to actinic radiation of at least $10^{-4}$ ergs/cm$^2$ for up to 100μ seconds duration in a pixel-by-pixel mode. The present invention realizes an improvement in contrast by modifying the radiation sensitive silver halide emulsion layer.

Like Budz et al, the present invention employs silver halide grains (a) containing greater than 50 mole percent chloride, based on silver, and (b) having greater than 50 percent of provided by area provided by {100} crystal faces. Unlike Budz et al, the present invention, extends to non-tabular as well as tabular grain emulsions.

It has been discovered quite unexpectedly that increased contrast in the method of Budz et al can be realized by modifying the preparation of conventional high chloride grains satisfying features (a) and (b) by employing in combination a dopant from each of classes (i), (ii) and (iii), set out in the summary of the invention above, and a gelatino-peptizer for the silver halide grains that contains less than 30 micromoles of methionine per gram.

Although natural sources of gelatin exist that contain less than 30 micromoles of methionine per gram, they are relatively rare. To obtain a peptizer useful in the practice of the invention it is generally necessary to treat a commercially available gelatin with a methionine oxidizing agent. This is disclosed by Maskasky U.S. Pat. No. 4,713,323 and King et al U.S. Pat. No. 4,942,120, the disclosures of which are here incorporated by reference, and by Takada et al EPO 0 434 012 and Okumura et al EPO 0 553 622. Examples of methionine oxidizing agents include NaOCl, chloramine, potassium monopersulfate, hydrogen peroxide and peroxide releasing compounds, ozone, thiosulfates and alkylating agents.

Although the art has established less than 30 micromoles per gram of gelatino-peptizer as the demarcation of low methionine gelatino-peptizers, it is appreciated that, in practice, when a gelatino-peptizer is treated with an oxidizing agent the methionine content is preferably reduced below 12 micromoles per gram and, optimally, below 5 micromoles per gram.

Since very small grains can be held in suspension without a peptizer, peptizer can be added after grain formation has been initiated, but in most instances it is preferred to add at least 10 percent and, most preferably, at least 20 percent, of the peptizer present at the conclusion of precipitation to the reaction vessel before grain formation occurs. The low methionine gelatino-peptizer is preferably the first peptizer to come into contact with the grains. Gelatino-peptizer with higher methionine levels can contact the grains, provided it is maintained below concentration levels sufficient to peptize the grains produced. For instance, any gelatino-peptizer with methionine level of greater than 30 micromoles per gram initially present is preferably held to a concentration of less than 1 percent of the total peptizer employed. While it is should be possible to use another type of peptizer toward the end of precipitation with minimal adverse impact on the emulsions, it is preferred that the low methionine gelatino-peptizer be used as the sole peptizer throughout grain formation and growth.

It is important to note that once grain growth has been completed any conventional vehicle, including gelatin and gelatin derivatives of higher methionine levels can be introduced while still realizing all of the advantages of the invention. Conventional useful vehicle materials and the addenda and modifiers used with them are illustrated by *Research Disclosure*, Item 38957, II. Vehicles, vehicle extenders, vehicle-like addenda and vehicle related addenda.

A class (i) dopant is a metal coordination complex containing a nitrosyl or thionitrosyl ligand in combination with a transition metal chosen from groups 5 to 10 inclusive of the periodic table of elements. In a preferred form class (i) dopant satisfies the formula:

$$[ML_4(NY)L']^n \quad (I)$$

wherein

M is a transition metal chosen from groups 5 to 10 inclusive of the periodic table of elements;

L'is L or (NY);

L is a bridging ligand, which can be independently selected in each occurrence and is anionic in at least four occurrences;

Y is oxygen or sulfur; and n is zero, −1, −2 or −3.

The performance of dopants satisfying formula (I) is derived primarily by the presence of a nitrosyl (NO) and thionitrosyl (NS) ligand, although practically influenced by the transition metal selection. The remaining ligands can be any convenient choice of bridging ligands, including additional nitrosyl and thionitrosyl ligands.

Specific examples of preferred bridging ligands other than nitrosyl and thionitrosyl include aquo ligands, halide ligands (specifically, fluoride, chloride, bromide and iodide), cyano ligands, cyanate ligands, thiocyanate ligands, selenocyanate ligands, tellurocyanate ligands, and azide ligands. The charge neutral ligands, the nitrosyl or thionitrosyl ligands and the aquo ligands, when present, collectively account for no more than two of the ligands. Hexacoordinated transition metal complexes which include in addition to their nitrosyl and thionitrosyl ligands up to five halide and/or cyanide ligands are specifically preferred.

Any transition metal capable of forming a coordination complex can be employed in the practice of the invention. The transition metals of groups 5 to 10 inclusive of the periodic table are known to form tetracoordination and hexacoordination complexes. Preferred transition metals include chromium, rhenium, ruthenium, osmium and iridium, with osmium and ruthenium generally providing optimum performance.

In a specifically preferred form the class (i) dopants satisfy the formula:

$$[M'L''_5(NY)]^n \quad (Ia)$$

wherein

M' represents chromium, rhenium, ruthenium or osmium;

L" represents one or a combination of halide and cyano ligands or a combination of these ligands with an aquo ligand;

Y is oxygen or sulfur; and n is zero, −1, −2 or −3.

In a further preferred form the dopants (i) satisfy the formula:

$$[M''X_5(NY)]^{-2} \quad (Ib)$$

wherein

M" represents osmium or ruthenium;

X represents a chloride or bromide ligand; and

Y is oxygen or sulfur.

When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. To avoid repetition, it is noted that the same comments apply to class (ii) and (iii) dopants, otherwise described below.

Listings of specific class (i) dopants, including those satisfying formulae (I), (Ia) and (Ib), are included in McDugal et al, Bell and McIntyre et al, each cited above, and here incorporated by reference.

Class (i) dopant is introduced into the high chloride grains before the addition to the reaction vessel of 95, preferably 75, percent of the silver forming the grains has been completed. Stated in terms of the fully precipitated grain structure, class (i) dopant is present in an interior region accounting for 95, preferably 75, percent of the high chloride grains. If desired, class (i) dopant can be added to the reaction vessel prior to grain nucleation. Alternatively, class (i) dopant can be added in a precipitation band at some intermediate stage of precipitation, or class (i) dopant can be added as precipitation is occurring so that it is distributed through the interior region of the grains.

Class (i) dopant can be employed in any conventional useful concentration. A preferred concentration range is from $10^{-10}$to $10^{-6}$ mole per silver mole, most preferably from $10^{-9}$ to $10^{-7}$ mole per silver mole.

The following are specific illustrations of class (i) compounds:

(i-1) $[Ru(NO)Cl_5]^{-2}$
(i-2) $[Ru(NO)Br_5]^{-2}$
(i-3) $[Ru(NO)I_5]^{-2}$
(i-4) $[Os(NO)Cl_5]^{-2}$
(i-5) $[Os(NO)Br_5]^{-2}$
(i-6) $[Ru(NS)Cl_5]^{-2}$
(i-7) $[Os(NS)Br_5]^{-2}$

The class (ii) dopant is a shallow electron trapping dopant. Using empirical techniques the art has over the years identified many class (ii) dopants capable of increasing photographic speed. Scientific investigations have gradually established that class (ii) dopants share the capability of providing shallow electron trapping sites. Olm et al U.S. Pat. No. 5,503,970 and Daubendiek et al U.S. Pat. Nos. 5,494,789 and 5,503,971, here incorporated by reference, as well as *Research Disclosure*, Vol. 367, November 1994, Item 36736, were the first to set out comprehensive criteria for a dopant to have the capability of providing shallow electron trapping sites.

When a photon is absorbed by a silver halide grain, an electron (hereinafter referred to as a photoelectron) is promoted from the valence band of the silver halide crystal lattice to its conduction band, creating a hole (hereinafter referred to as a photo-hole) in the valence band. To create a latent image site within the grain, a plurality of photoelectrons produced in a single imagewise exposure must reduce several silver ions in the crystal lattice to form a small cluster of $Ag^O$ atoms. To the extent that photo-electrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the high chloride grains to create within them shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kansaki, K. Kobayshi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron ooccupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectro-chemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of metal ions in the spectrochemical series is apparent:

$$I^- < Br^- < S^{-2} < \underline{S}CN^- < Cl^- < NO_3^- < F^- < \underline{O}H < ox^{-2} < H_2\underline{O} < \underline{N}CS^- < CH_3\underline{C}N^- < \underline{N}H_3 < en < dipy < phen < \underline{N}O_2^- < phosph << \underline{C}N^- < \underline{C}O.$$

The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr^{+3} >> V^{+3} < Co^{+3} < Mn^{+4} < Mo^{+3} < Rh^{+3} >> Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (b), Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

In a preferred form the class (ii) dopants contemplated for use in the practice of this invention are hexacoordination complexes. They contain a metal ion and six ligands that displace a silver ion and six adjacent halide ions in the crystal lattice. One or two of the coordination sites can be occupied by neutral ligands, such as carbonyl, aquo or amine ligands, but the remainder of the ligands are anionic to facilitate efficient incorporation of the coordination complex in the crystal lattice structure.

Illustrations of specifically contemplated class (ii) hexacoordination complexes for inclusion in the high chloride grains are provided by Bell, cited above, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for class (ii) dopant hexacoordination complexes are disclosed by Olm et al U.S. Pat. No. 5,360,712 and Kuromoto et al U.S. Pat. No. 5,462,849, the disclosures of which are here incorporated by reference.

In a specific, preferred form it is contemplated to employ as a class (ii) shallow electron trapping dopant a hexacoordination complex satisfying the formula:

$$[ML_6]^n \quad \text{(II)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands described above other than nitrosyl or thionitrosyl ligands. In a specifically preferred form any remaining ligand is a halide ligand.

Class (ii) dopant is preferably introduced into the high chloride grains after at least 50 (most preferably 75 and optimally 80) percent of the silver has been precipitated, but before precipitation of the central portion of the grains has been completed. Preferably class (ii) dopant is introduced before 98 (most preferably 95 and optimally 90) percent of the silver has been precipitated. Stated in terms of the fully precipitated grain structure, class (ii) dopant is preferably present in an interior shell region that surrounds at least 50 (most preferably 75 and optimally 80) percent of the silver and, with the more centrally located silver, accounts the entire central portion (98 percent of the silver), most preferably accounts for 95 percent, and optimally accounts for 90 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (ii) dopants:

| | |
|---|---|
| (ii-1) | $[Fe(CN)_6]^{-4}$ |
| (ii-2) | $[Ru(CN)_6]^{-4}$ |
| (ii-3) | $[Os(CN)_6]^{-4}$ |
| (ii-4) | $[Rh(CN)_6]^{-3}$ |
| (ii-5) | $[Ir(CN)_6]^{-3}$ |
| (ii-6) | $[Fe(pyrazine)(CN)_5]^{-4}$ |
| (ii-7) | $[RuCl(CN)_5]^{-4}$ |
| (ii-8) | $[OsBr(CN)_5]^{-4}$ |
| (ii-9) | $[RhF(CN)_5]^{-3}$ |
| (ii-10) | $[IrBr(CN)_5]^{-3}$ |
| (ii-11) | $[FeCO(CN)_5]^{-3}$ |
| (ii-12) | $[RuF_2(CN)_4]^{-4}$ |
| (ii-13) | $[OsCl_2(CN)_4]^{-4}$ |
| (ii-14) | $[RhI_2(CN)_4]^{-3}$ |
| (ii-15) | $[IrBr_2(CN)_4]^{-3}$ |
| (ii-16) | $[Ru(CN)_5(OCN)]^{-4}$ |
| (ii-17) | $[Ru(CN)_5(N_3)]^{-4}$ |
| (ii-18) | $[Os(CN)_5(SCN)]^{-4}$ |
| (ii-19) | $[Rh(CN)_5(SeCN)]^{-3}$ |
| (ii-20) | $[Ir(CN)_5(HOH)]^{-2}$ |
| (ii-21) | $[Fe(CN)_3Cl_3]^{-3}$ |
| (ii-22) | $[Ru(CO)_2(CN)_4]^{-1}$ |
| (ii-23) | $[Os(CN)Cl_5]^{-4}$ |
| (ii-24) | $[Co(CN)_6]^{-3}$ |

-continued

| | |
|---|---|
| (ii-25) | $[IrCl_4(oxalate)]^{-4}$ |
| (ii-26) | $[In(NCS)_6]^{-3}$ |
| (ii-27) | $[Ga(NCS)_6]^{-3}$ |

Careful scientific investigations have revealed Group VIII hexahalo coordination complexes to create deep electron traps, as illustrated R. S. Eachus, R. E. Graves and M. T. Olm J. *Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986).

Class (iii) dopants employed in the practice of this invention are believed to create deep electron traps. The class (iii) dopant is an iridium coordination complex not satisfying class (i) or (ii) requirements.

The class (iii) dopant is an iridium coordination complex having ligands each of which are more electropositive than a cyano ligand. In a specifically preferred form the ligands of the coordination complexes forming class (iii) dopants are halide ligands. Although it has been known and reported for many years that simple salts of iridium can be used for doping, mechanistic investigations indicate that the metal ions form coordination complexes with halide ion in solution before incorporation within the crystal lattice structure of the grains occurs. This invention includes as class (iii) dopants iridium ions added as metal ions.

Although halide and other anionic ligands facilitate incorporation of iridium ions in the crystal lattice structure of the high chloride grains, it is the metal ions themselves that provide deep electron trapping sites. Thus, in choosing ligands for the coordination complexes of class (iii) dopants the object is primarily to avoid any ligand that will unduly limit the electron trapping capability of the iridium ions. Thus, the nitrosyl or thionitrosyl ligands of class (i) dopants are excluded as well as the cyano and at least equally strongly electron withdrawing ligands present in class (ii) dopants. Any of the remaining ligands listed above as optional ligands for class (i) and (ii) dopants can be selected. It is specifically contemplated to select class (iii) dopants from among the coordination complexes containing organic ligands disclosed by Olm et al U.S. Pat. No. 5,360,712 and Kuromoto et al U.S. Pat. No. 5,360,712, the disclosures of which are here incorporated by reference.

The class (iii) iridium dopants are illustrated by Bell U.S. Pat. Nos. 5,474,888, 5,470,771 and 5,500,335 and McIntyre et al , each cited above and here incorporated by reference.

In a preferred form it is contemplated to employ as a class (iii) dopant a hexacoordination complex satisfying the formula:

$$[IrL_6]^n \quad \text{(III)}$$

where n is zero, −1, −2, −3 or −4 and $L_6$ represents six bridging ligands, which can be independently selected, provided that least four of the ligands are anionic ligands and each of the ligands is more electropositive than a cyano ligand. In a specifically preferred form the ligands are halide ligands, such as chloride or bromide ligands.

Class (iii) dopant is preferably introduced into the high chloride grains after at least 50 (most preferably 85 and optimally 90) percent of the silver has been precipitated, but before precipitation of the central portion of the grains has been completed. Preferably class (iii) dopant is introduced before 98 (most preferably 97 and optimally 95) percent of the silver has been precipitated. Stated in terms of the fully precipitated grain structure, class (iii) dopant is preferably present in an interior shell region that surrounds at least 50 (most preferably 85 and optimally 90) percent of the silver and, with the more centrally located silver, accounts the entire central portion (98 percent of the silver), most preferably accounts for 97 percent, and optimally accounts for 95 percent of the silver halide forming the high chloride grains. The class (iii) dopant can be distributed throughout the interior shell region delimited above or can be added as one or more bands within the interior shell region.

Class (iii) dopant can be employed in any conventional useful concentration. A preferred concentration range is from $10^{-9}$ to $10^{-5}$ mole per silver mole. Iridium is most preferably employed in a concentration range of from $10^{-8}$ to $10^{-6}$ mole per silver mole.

Specific illustrations of class (iii) dopants are the following:

| | |
|---|---|
| (iii-1) | $[IrCl_6]^{-3}$ |
| (iii-2) | $[IrBr_6]^{-3}$ |
| (iii-3) | $[IrCl_4(en)_2]^{-1}$ |
| (iii-4) | $[IrCl_4(MeSCH_2CH_2SMe)]^{-1}$ |
| (iii-5) | $[IrCl_5(pyz)]^{-2}$ |
| (iii-6) | $[IrCl_4(pyz)_2]^{-1}$ |
| (iii-7) | $[IrCl_5(Cl\text{-}pyz)]^{-1}$ |
| (iii-8) | $[IrCl_5(N\text{—}Me\text{-}pyzm)]^{-1}$ |
| (iii-9) | $[IrCl_5(pym)]^{-2}$ |
| (iii-10) | $[IrCl_5(py)]^{-2}$ |
| (iii-11) | $[IrCl_4(py)_2]^{-1}$ |
| (iii-12) | $[IrCl_4(C_2O_4)_2]^{-3}$ |
| (iii-13) | $[IrCl_5(th)]^{-2}$ |
| (iii-14) | $[IrCl_5(Me\text{-}th)]^{-2}$ |

en=enthlenediamine
Me=methyl
py=pyridine
pym=pyrimidine
pyz=pyrazine
pyzm=pyrazinium
th=thiazole Emulsions demonstrating the advantages of the invention can be realized by modifying the precipitation of conventional high chloride silver halide grains having predominantly (>50%) {100} crystal faces by employing a combination of a low methionine gelatino-peptizer and class (i), (ii) and (iii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 μm, preferably less than 0.2 μm, and optimally less than 0.07 μm. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Once high chloride grains having predominantly {100} crystal faces have been precipitated employing low methionine gelatino-peptizer and the combination of class (i), (ii) and (iii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

In the simplest contemplated form a recording element contemplated for use in the electronic printing method of the invention can consist of a single emulsion layer satisfying the emulsion description provided above coated on a conventional photographic support, such as those described in *Research Disclosure* Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

The method of the invention can be used to form either silver or dye images in the recording element. In a simple form in which a single radiation sensitive emulsion layer unit is coated on the support. The emulsion layer unit can contain one or more high chloride silver halide emulsions satisfying the requirements of the invention, either blended or located in separate layers. When a dye imaging forming compound, such as a dye-forming coupler, is present in the layer unit, it can be present in an emulsion layer or in a layer coated in contact with the emulsion layer. With a single emulsion layer unit a monochromatic image is obtained.

In a preferred form the method of the invention employs recording elements are constructed to contain at least three silver halide emulsion layer units. A suitable multicolor, multilayer format for a recording element used in the electronic printing method of this invention is represented by Structure I.

| STRUCTURE I |
|---|
| Blue-sensitized |
| yellow dye image-forming silver halide emulsion unit |
| Interlayer |
| Green-sensitized |
| magenta dye image-forming silver halide emulsion unit |
| Interlayer |
| Red-sensitized |
| cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units.

Another useful multicolor, multilayer format for an element of the invention is the so-called inverted layer order represented by Structure II.

| STRUCTURE II |
|---|
| Green-sensitized |
| magenta dye image-forming silver halide emulsion unit |
| Interlayer |
| Red-sensitized |
| cyan dye image-forming silver halide emulsion unit |
| Interlayer |
| Blue-sensitized |
| yellow dye image-forming silver halide emulsion unit |
| ///// Support ///// |

wherein the blue-sensitized, yellow dye image-forming silver halide unit is situated nearest the support, followed next by the red-sensitized, cyan dye image-forming unit, and uppermost the green-sensitized, magenta dye image-forming unit.

Still another suitable multicolor, multilayer format for an element of the invention is illustrated by Structure III.

| Structure III |
|---|
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| ///// Support ///// |

wherein the blue-sensitized, yellow dye image-forming silver halide unit is situated nearest the support, followed next by the green-sensitized, magenta dye image-forming unit, and uppermost the red-sensitized, cyan dye image-forming unit.

Three additional useful multicolor, multilayer formats are represented by Structures IV, V, and VI.

| STRUCTURE IV |
|---|
| $IR^1$ - sensitized |
| yellow dye image-forming silver halide emulsion unit |
| Interlayer |
| $IR^2$ - sensitized |
| magenta dye image-forming silver halide emulsion unit |
| Interlayer |
| $IR^3$ - sensitized |
| cyan dye image-forming silver halide emulsion unit |
| ///// Support ///// |

| STRUCTURE V |
|---|
| $IR^1$ - sensitized |
| magenta dye image-forming silver halide emulsion unit |
| Interlayer |
| $IR^2$ - sensitized |
| cyan dye image-forming silver halide emulsion unit |
| Interlayer |
| $IR^3$ - sensitized |
| yellow dye image-forming silver halide emulision unit |
| ///// Support ///// |

| STRUCTURE VI |
|---|
| $IR^1$ - sensitized |
| cyan dye image-forming silver halide emulsion unit |
| Interlayer |
| $IR^2$ - sensitized |
| magenta dye image-forming silver halide emulsion unit |
| Interlayer |
| $IR^3$ - sensitized |
| yellow dye image-forming silver halide emulsion unit |
| ///// Support ///// |

Structures IV, V, and VI are analogous to the above-described Structures I, II and III, respectively, except that the three emulsion units are sensitized to different regions of the infrared (IR) spectrum. Alternatively, only one or two of the emulsion units in Structures IV, V, and VI may be IR-sensitized, the remaining unit(s) being sensitized in the visible.

Each of Structures I, II, III, IV, V and VI contain at least one silver halide emulsion comprised of a low methionine gelatino-peptizer and high chloride grains having at least 50 percent of their surface area bounded by {100} crystal faces and containing dopants from classes (i), (ii) and (iii), as described above. Preferably each of the emulsion layer units contain an emulsion satisfying these criteria.

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Image-wise exposures at ambient, elevated or reduced temperatures and/or pressures can be employed within the useful response range of the recording element determined by conventional sensitometric techniques, as illustrated by T. H. James, *The*

*Theory of the Photographic Process*, 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100μ seconds, often up to 10μ seconds, and frequently up to only 0.5μ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing and stabilizing

EXAMPLES

The invention can be better appreciated by reference to the following specific embodiments. The term "non-oxidized gelatin" is used to indicate gelatin that was not treated with an oxidizing agent to reduce its methionine content and that had a naturally occurring methionine content about 50 micrograms per gram. The term "oxidized gelatin" is used to indicate gelatin that had been treated with a strong oxidizing agent to reduce its methionine content to less than 5 micrograms per gram.

Emulsion Preparations

Emulsion A

A reaction vessel was loaded with 5.0 L of a solution that was 8% in oxidized gelatin, 7.5 grams in NaCl and 0.25 mL of Nalco 2341™ antifoaming agent. The contents of the reaction vessel were maintained at 55° C., and the pCl was adjusted to 1.5. To this stirred solution at 55° C. were added simultaneously and at 18 mL/min each 4.0M $AgNO_3$ and 4.0M NaCl solutions over 1 minute. Silver nitrate solution contained $3\times10^{-6}$ mole of mercuric chloride per mole of silver. Then these solutions were added at ramped flow from 18 to 80 mL/min over 20 minutes, followed by constant rate addition at 80 mL/min over 40 minutes. The emulsion then was cooled down to 43° C. over 8 minutes.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion B

This emulsion was precipitated exactly as Emulsion A, except that 10μ-grams per silver mole of $Cs_2Os(NO)Cl_3$ were added during precipitation during 0 to 75% of grain formation.

Emulsion C

This emulsion was precipitated exactly as Emulsion A, except that 10μ-grams per silver mole of $Cs_2Os(NO)Cl_3$ were added during precipitation during 0 to 75% of grain formation and 25 milligrams per silver mole of $K_4Ru(CN)_6$ were added during precipitation during 80 to 85% of grain formation.

Emulsion D

This emulsion was precipitated exactly as Emulsion A, except that 10μ-grams per silver mole of $Cs_2Os(NO)Cl_3$ were added during precipitation during 0 to 75% of grain formation and 25 milligrams per silver mole of $K_4Ru(CN)_6$ were added during precipitation during 80 to 85% of grain formation and 0.04 milligram per silver mole of $K_2IrCl_6$ was added during precipitation during 93 to 95% of grain formation.

Emulsion E

This emulsion was precipitated exactly as Emulsion A, except that 25 milligrams per silver mole of $K_4Ru(CN)_6$ was added during precipitation during to 80 to 85% of grain formation and 0.04 milligram per silver mole of $K_2IrCl_6$ was added during precipitation during to 93 to 95% of grain formation.

Emulsion F

This emulsion was precipitated exactly as

Emulsion A, except that 0.04 milligram per silver mole of $K_2IrCl_6$ was added during precipitation during 93 to 95% of grain formation.

Emulsion G

This emulsion was precipitated exactly as Emulsion A, except that 10μ-grams per silver mole of $Cs_2Os(NO)Cl_3$ was added during precipitation during 0 to 75% of grain formation and 0.04 milligrams per silver mole of $K_2IrCl_6$ was added during precipitation during to 93 to 95% of grain formation.

Emulsion H

This emulsion was precipitated exactly as Emulsion A, except that 25 milligrams per silver mole of $K_4Ru(CN)_6$ was added during precipitation during to 80 to 85% of grain formation.

Emulsion I

A reaction vessel contained 5.0 L of a solution that was 8% in non-oxidized gelatin, 7.5 grams in NaCl and 0.25 mL of Nalco 2341™ antifoaming agent. The contents of the reaction vessel were maintained at 55° C., and the pCl was adjusted to 1.5. To this stirred solution at 55° C. was added simultaneously and at 18 mL/min each 4.0M $AgNO_3$ and 4.0M NaCl solutions over 1 minute. The silver nitrate solution contained $3\times10^{-6}$ mole of mercuric chloride per mole of silver. Then these solutions were added at ramped flow from 18 to 80 mL/min over 20 minutes, followed by constant rate addition at 80 mL/min over 40 minutes. The emulsion then was cooled down to 43° C. over 8 minutes.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion J

This emulsion was precipitated exactly as Emulsion I, except that 10μ-grams per silver mole of $Cs_2Os(NO)Cl_3$ were added during precipitation during 0 to 75% of grain formation.

Emulsion K

This emulsion was precipitated exactly as Emulsion I, except that 10μ-grams per silver mole of $Cs_2Os(NO)Cl_3$ were added during precipitation during 0 to 75% of grain formation and 25 milligrams per silver mole of $K_4Ru(CN)_6$ were added during precipitation during to 80 to 85% of grain formation.

Emulsion L

This emulsion was precipitated exactly as Emulsion I, except that 10μ-grams per silver mole of $Cs_2Os(NO)Cl_3$ were added during precipitation during 0 to 75% of grain formation and 25 milligrams per silver mole of $K_4Ru(CN)_6$ were added during precipitation during to 80 to 85% of grain formation and 0.04 milligram per silver mole of $K_2IrCl_6$ was added during precipitation during to 93 to 95% of grain formation.

Emulsion M

This emulsion was precipitated exactly as Emulsion I, except that 25 milligrams per silver mole of $K_4Ru(CN)_6$ were added during precipitation during to 80 to 85% of grain formation and 0.04 milligram per silver mole of $K_2IrCl_6$ was added during precipitation during to 93 to 95% of grain formation.

Emulsion N

This emulsion was precipitated exactly as Emulsion I, except that 0.04 milligram per silver mole of $K_2IrCl_6$ was added during precipitation during to 93 to 95% of grain formation.

Emulsion O

This emulsion was precipitated exactly as Emulsion I, except that 10μ-grams per silver mole of $Cs_2Os(NO)Cl_3$ were added during precipitation during 0 to 75% of grain formation and 0.04 milligram per silver mole of $K_2IrCl_6$ was added during precipitation during to 93 to 95% of grain formation.

Emulsion P

This emulsion was precipitated exactly as Emulsion I, except that 25 milligrams per silver mole of $K_4Ru(CN)_6$ were added during precipitation during 80 to 85% of grain formation.

Emulsion R

A tabular silver iodochloride emulsion was precipitated as follows:

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25. While this solution was vigorously stirred, 90 mL of 2.0M silver nitrate solution and 90 mL of a 1.99M sodium chloride were added simultaneously at a rate of 180 mL/min each. The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25. Finally, 0.75M silver nitrate solution and 0.75M sodium chloride solution were each added at a constant rate of 37.1 mL/min over 90 minutes, the pCl being maintained at 2.25. The emulsion was then washed using an ultrafiltration unit, and its final pH and pCl were adjusted to 5.5 and 1.8, respectively.

The resulting emulsion was a silver iodochloride {100} tabular grain emulsion containing 0.06 mole percent iodide, based on silver. More than 50 percent of total grain projected area was provided by tabular grains having {100} major faces with an average ECD of 1.65 μm and an average thickness of 0.15 μm.

Emulsion S

This emulsion was precipitated exactly as Emulsion R, except that 2.33μ-grams per silver mole of $Cs_2Os(NO)Cl_3$ were added during precipitation during 0 to 90% of grain formation, and 15 parts per million of $K_4Ru(CN)_6$ were added during precipitation during 90 to 95% of grain formation and 0.01 milligrams per silver mole of $K_2IrCl_6$ was added during precipitation during to 95 to 100% of grain formation.

Example 1

This example compares results obtained with the method of the invention with results obtained by methods that are identical, except for the selection of the gelatino-peptizer and/or dopants required by the invention.

Emulsions A through P were sensitized as follows: A portion of each emulsion was melted at 40° C., and the supersensitizing compound 4,4'-[6-(2-chloroanilino)-4-chloro-1,3,5-triazin-2-yl]aminostilbene 2,2'-sulfonic acid, disodium salt was added, followed by the optimized addition of colloidal gold sulfide. The emulsion then was heated to 65° C. and ripened for 40 minutes. After cooling down to 40° C., 1-(3-acetamidophenyl)-5-mercaptotetrazole was added followed by the addition of potassium bromide and red sensitizing dye D-1, anhydro-3-ethyl-9,11-neopentylene-3'-(3-sulfopropyl)thiadiacarbocyanine hydroxide.

The suffix R has been added to emulsion descriptor to indicate spectral sensitization to red light.

Each emulsion was coated at 1.82 mg silver per square decimeter on resin-coated paper support. The coatings were overcoated with gelatin layer, and the entire coating was hardened with bis(vinylsulfonylmethyl)ether.

Coatings were exposed with a Laser Enlarger exposure apparatus at 633 nm, at a resolution of 94 pixels/cm, a pixel pitch of 50.8 μm. Exposure time was 0.814 microsecond per pixel. The speed (RLS) was taken at density=2.3. Contrast (γ) was measured between 0.2 and 2.3 density points.

All coatings were processes in Kodak™ Ektacolor RA-4 processing.

TABLE II

| Emul. | Gel type | (i) Os | (ii) Ru | (iii) Ir | Dmin/Dmax | RLS | γ |
|---|---|---|---|---|---|---|---|
| A-R | Ox* | — | — | — | 0.11/2.61 | 93.8 | 2.32 |
| B-R | " | x | — | — | 0.11/2.59 | 59.3 | 2.61 |
| C-R | " | x | x | — | 0.12/2.65 | 56.0 | 3.87 |
| D-R | " | x | x | x | 0.12/2.56 | 71.1 | 4.73 |
| E-R | " | — | x | x | 0.12/2.65 | 88.4 | 2.35 |
| F-R | " | — | — | x | 0.12/2.63 | 77.6 | 2.82 |
| G-R | " | x | — | x | 0.11/2.62 | 80.4 | 2.90 |
| H-R | " | — | x | — | 0.12/2.62 | 81.6 | 1.87 |
| I-R | N/Ox** | — | — | — | 0.11/2.55 | 70.5 | 1.68 |
| J-R | " | x | — | — | 0.11/2.54 | 54.8 | 2.06 |
| K-R | " | x | x | — | 0.11/2.56 | 44.7 | 1.80 |
| L-R | " | x | x | x | 0.11/2.57 | 60.5 | 2.16 |
| M-R | " | — | x | x | 0.12/2.55 | 76.7 | 1.54 |
| N-R | " | — | — | x | 0.11/2.63 | 93.3 | 2.57 |
| O-R | " | x | — | x | 0.11/2.55 | 75.4 | 2.78 |
| P-R | " | — | x | — | 0.12/2.56 | 104.9 | 1.77 |

*Ox = Oxidized gelatin
**N/OX = Non-oxidized gelatin

From Table II it is apparent that low methionine gelatin combined with class (i), class (ii) and class (iii) dopants (D-R) yielded maximum contrast with laser exposure.

Example 2

This example compares an emulsion satisfying the requirements of the method of the invention with a comparison emulsion sensitized for green laser exposures.

Emulsions A and D were sensitized as follows: A portion of silver chloride emulsion was melted at 40° C. and the green spectral sensitizing dye anhydro-5-chloro-9-ethyl-5'-phenyl-3'-(3-sulfobutyl)-3-(3-sulfopropyl)oxa-carbocyanine hydroxide, sodium salt was added followed by an optimized addition of colloidal gold-sulfide. Then the emulsion was heated to 60° C. and ripened for 40 minutes. After cooling down to 40° C. 1-(3-acetamidophenyl)-5-mercaptotetrazole was added followed by the addition of potassium bromide. These emulsions were designated as A-G and D-G.

Coatings were exposed with a Laser Enlarger exposure apparatus at 514 nm, a resolution of 98 pixels/cm, and a pixel pitch of 50.8 μm. Exposure time was 0.814 microsecond per pixel. Speed (RLS) was taken at density=1.8. Contrast (γ) was measured between 0.2 and 1.8 density points.

All coatings were processes in Kodak™ Ektacolor RA-4 processing.

TABLE III

| Emul. | Gel type | (i) Os | (ii) Ru | (iii) Ir | Dmin/Dmax | RLS | γ |
|---|---|---|---|---|---|---|---|
| A-G | Ox | — | — | — | 0.22/2.61 | 145 | 1.73 |
| D-G | " | x | x | x | 0.13/2.49 | 74 | 2.55 |

From Table III it is apparent that dopants increased contrast by 47 percent. Minimum density was lowered by the dopants. Maximum density was only slightly lowered by the dopants. Although speed was lowered, speed remained in a range capable of compensation by laser adjustment.

Example 3

This example compares an emulsion satisfying the requirements of the method of the invention with a comparison emulsion sensitized for blue laser exposures.

Emulsions R and S were sensitized as follows: A portion of silver chloride emulsion was melted at 40° C. and blue sensitizing dye, anhydro-5-chloro-3,3'-bis(3-sulfopropyl) naphtho[1,2-d]thiazolothiacyanine hydroxide triethylammonium salt, was added followed by the addition of potassium bromide and an optimized amount of colloidal gold-sulfide. Then the emulsion was heated to 60° C. and ripened for 40 minutes. After cooling down to 40° C. 1-(3-acetamidophenyl)-5-mercaptotetrazole was added. These emulsions were designated as R-B and S-B.

Coatings were exposed with a Laser Enlarger exposure apparatus at 476 nm, a resolution of 98 pixels/cm, and a pixel pitch of 50.8 μm. Exposure time was 0.814 microsecond per pixel. Speed (RLS) was taken at density=1.8. Contrast (γ) was measured between 0.2 and 1.8 density points.

All coatings were processes in Kodak™ Ektacolor RA-4 processing.

TABLE IV

| Emul. | Gel type | (i) Os | (ii) Ru | (iii) Ir | Dmin/Dmax | RLS | γ |
|---|---|---|---|---|---|---|---|
| R-B | Ox | — | — | — | 0.07/2.62 | 100 | 1.68 |
| S-B | " | x | x | x | 0.07/2.57 | 80 | 2.29 |

From Table IV it is apparent that dopants increased contrast by 36 percent. Minimum density was unchanged. Maximum density was only slightly lowered by the dopants. Although speed was lowered, speed remained in a range capable of compensation by laser adjustment.

Example 4

This example demonstrates a color paper designed for digital exposures in which all three color recording emulsions were precipitated in oxidized gelatin and contain class (i), (ii) and (iii) dopants.

Silver chloride emulsions were chemically and spectrally sensitized as follows:

Blue Sensitive Emulsion (Blue EM-1) was prepared similarly to that described in Example 3 as S-B.

Green Sensitive Emulsion (Green EM-1) was prepared similarly to that described in EXAMPLE 2 as D-G.

Red Sensitive Emulsion (Red EM-1) was prepared similarly to that described in EXAMPLE 1 as D-R.

Coupler dispersions were emulsified by methods well known to the art, and the following layers were coated on a polyethylene resin coated paper support that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl)stilbene and 4,4'-bis(2-benzoxazolyl)stilbene, 12.5% $TiO_2$, and 3% ZnO white pigment. The layers were hardened with bis (vinylsulfonyl methyl)ether at 1.95% of the total gelatin weight. Coating coverages are reported in $g/m^2$, except as otherwise noted. Emulsion layer coating coverages are based on silver.

| Layer 1: Blue Sensitive Layer | |
|---|---|
| Gelatin | 1.528 |
| Blue Sensitive Silver (Blue EM-1) | 0.253 |
| Y-4 | 0.484 |
| Dibutyl phthalate | 0.330 |
| N-tert-butylacrylamide/2-acrylamido-2-methylpropane sulfonic acid sodium salt (99/1 ratio mixture) | 0.484 |
| 2,5-Dihydroxy-5-methyl-3-(1-piperidinyl)-2-cyclopenten-1-one | 0.002 |
| ST-16 | 0.009 |
| KCl | 0.020 |
| DYE-1 | 0.009 |
| **Layer 2: Interlayer** | |
| Gelatin | 0.753 |
| Dioctyl hydroquinone | 0.108 |
| Dibutyl phthalate | 0.308 |
| Disodium-4,5-Dihydroxy-m-benzenedisulfonate | 0.065 |
| SF-1 | 0.011 |
| Irganox 1076 ™ | 0.016 |
| **Layer 3: Green Sensitive Layer** | |
| Gelatin | 1.270 |
| Green Sensitive Silver (Green EM-1) | 0.212 |
| M-1 | 0.423 |
| Tris (2-ethylhexyl)phosphate | 0.409 |
| 2-(2-butoxyethoxy)ethyl acetate | 0.069 |
| ST-2 | 0.327 |
| Dioctyl hydroquinone | 0.042 |
| 1-(3-Benzamidophenyl)-5-mercaptotetrazole | 0.001 |
| DYE-2 | 0.006 |
| KCl | 0.020 |
| **Layer 4: UV Interlayer** | |
| Gelatin | 0.822 |
| UV-1 | 0.060 |
| UV-2 | 0.342 |
| Dioctyl hydroquinone | 0.082 |
| 1,4-Cyclohexylenedimethylene bis(2-ethylhexanoate) | 0.157 |
| **Layer 5: Red Sensitive Layer** | |
| Gelatin | 1.389 |
| Red Sensitive Silver (Red EM-1) | 0.187 |
| C-3 | 0.423 |
| Dibutyl phthalate | 0.415 |

-continued

| | |
|---|---|
| UV-2 | 0.272 |
| 2-(2-butoxyethoxy)ethyl acetate | 0.035 |
| Dioctyl hydroquinone | 0.005 |
| Potassium tolylthiosulfonate | 0.003 |
| Potassium tolylsulfinate | 0.0003 |
| Silver phenylmercaptotetrazole | 0.0009 |
| DYE-3 | 0.023 |
| **Layer 6: UV Overcoat** | |
| Gelatin | 0.382 |
| UV-1 | 0.028 |
| UV-2 | 0.159 |
| Dioctyl hydroquinone | 0.038 |
| 1,4-Cyclohexylenedimethylene bis(2-ethylhexanoate) | 0.073 |
| **Layer 7: SOC** | |
| Gelatin | 1.076 |
| Polydimethylsiloxane | 0.027 |
| SF-1 | 0.009 |
| SF-2 | 0.0026 |
| SF-12 | 0.004 |
| Tergitol 15-S-5 ™ | 0.003 |

In a variant form the multicolor element described above was modified by substituting the following green layer:

| Layer 3: Green Sensitive Layer | |
|---|---|
| Gelatin | 1.259 |
| Green Sensitive Silver (Green EM-1) | 0.145 |
| M-2 | 0.258 |
| Tris(2-ethylhexyl)phosphate | 0.620 |
| ST-5 | 0.599 |
| ST-21 | 0.150 |
| Dioctyl hydroquinone | 0.095 |
| HBAPMT | 0.001 |
| KCl | 0.020 |
| BIO-1 | 0.010* |
| DYE-2 | 0.006 |

*mg/m$^2$

Structures:

Y-4

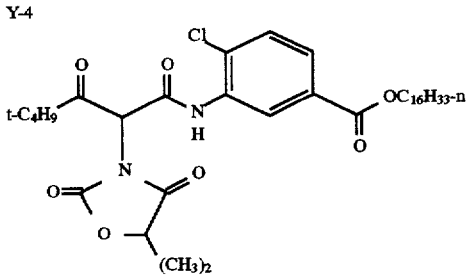

M-1

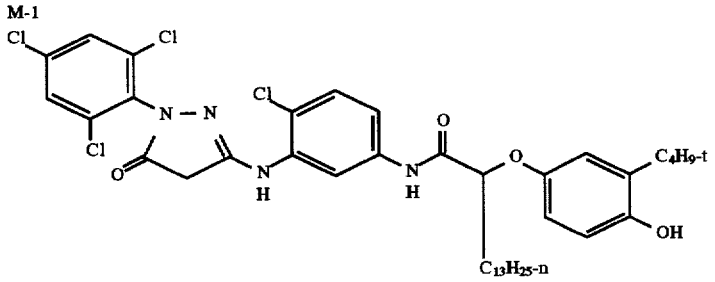

M2
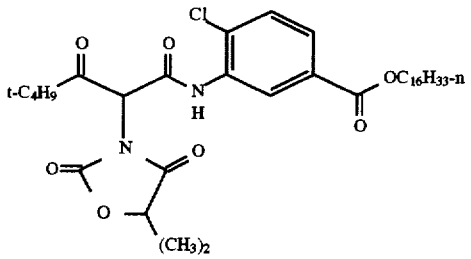
-continued
C-1
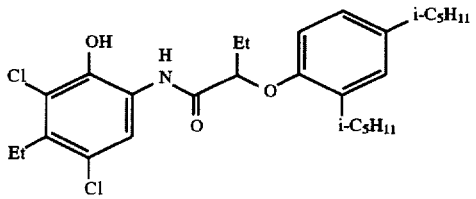
ST-2
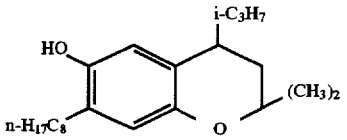
ST-5
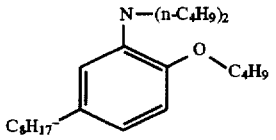
ST-16
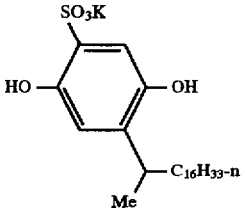
ST-21
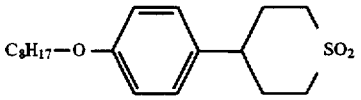
DYE-1
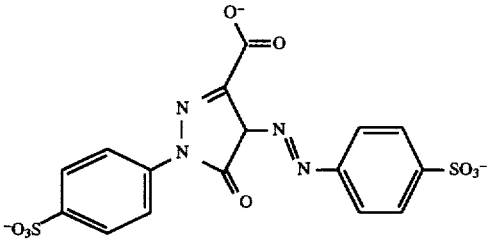
DYE-2
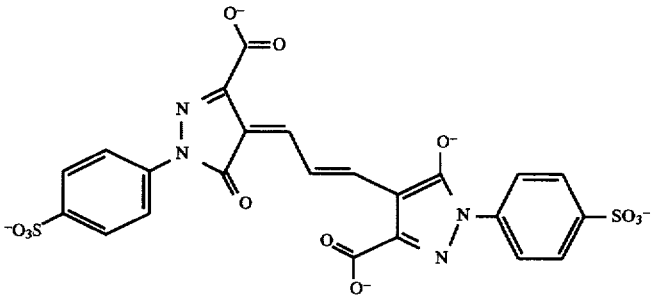
DYE-3
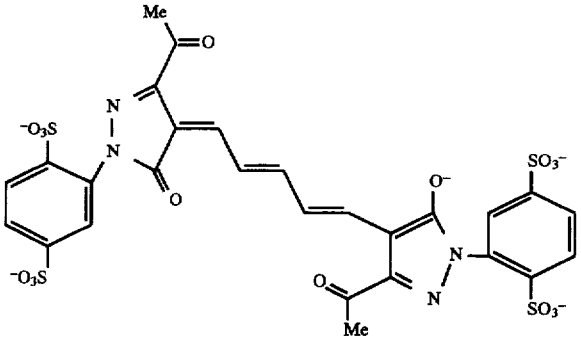
UV-1
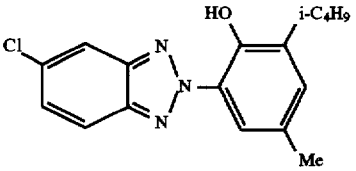
UV-2
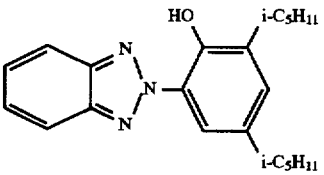
SF-1
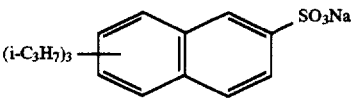

SF-2
$CF_3(CF_2)_7SO_3Na$

BIO-1

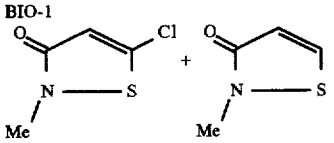

-continued
SF-12

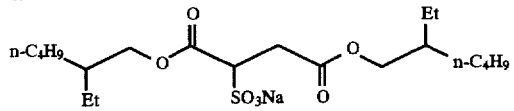

The invention has been described in detail with particular reference to preferred embodiments thereof, but it will be understood that variations and modifications can be effected within the spirit and scope of the invention.

What is claimed is:

1. An electronic printing method which comprises subjecting a radiation sensitive silver halide emulsion layer of a recording element to actinic radiation of at least $10^{-4}$ ergs/cm$^2$ for up to 100μ seconds duration in a pixel-by-pixel mode, wherein the silver halide emulsion layer is comprised of (1) silver halide grains
  (a) containing greater than 50 mole percent chloride, based on silver,
  (b) having greater than 50 percent of their surface area provided by {100} crystal faces, and
  (c) having a central portion accounting for from 95 to 98 percent of total silver and containing three dopants each selected to satisfy a different one of the following class requirements:
    (i) a metal coordination complex containing a nitrosyl or thionitrosyl ligand in combination with a transition metal chosen from groups 5 to 10 inclusive of the periodic table of elements,
    (ii) a shallow electron trapping dopant, and
    (iii) an iridium coordination complex having ligands which are more electropositive than a cyano ligand, and (2) a gelatino-peptizer for the silver halide grains that contains less than 30 micromoles of methionine per gram.

2. A method according to claim 1 wherein the pixels are exposed to actinic radiation of about $10^{-3}$ ergs/cm$^2$ to $10^2$ ergs/cm$^2$.

3. A method according to claim 1 wherein the exposure is up to 10μ seconds.

4. A method according to claim 1 wherein the duration of the exposure is up to 0.5μ seconds.

5. A method according to claim 1 wherein the duration of the exposure is up to 0.05μ seconds.

6. A method according to claim 1 wherein the source of actinic radiation is a light emitting diode.

7. A method according to claim 1 wherein the source of actinic radiation is a laser.

8. A method according to claim 1 wherein the silver halide grains contain at least 70 mole percent chloride, based on silver.

9. A method according to claim 1 wherein the silver halide grains contain less than 5 mole percent iodide, based on silver.

10. A method according to claim 9 wherein the silver halide grains contain less than 2 mole percent iodide, based on silver.

11. A method according to claim 1 wherein the gelatino-peptizer contains less than 12 micromoles of methionine per gram.

12. A method according to claim 11 wherein the gelatino-peptizer contains less than 5 micromoles of methionine per gram.

13. A method according to claim 1 wherein the class (i) dopant is located entirely within the central portion of the grains and is present in a concentration of from $10^{-10}$ to $10^{-6}$ mole per mole of silver, the class (ii) dopant is located within the central portion of grains in an interior shell region surrounding at least 50 percent of the total silver forming the grains and is present in a concentration of from $10^{-8}$ to $10^{-3}$ mole per mole of silver, and the class (iii) dopant is located within the central portion of the grains in an interior shell region surrounding at least 50 percent of the total silver forming the grains and is present in a concentration of from $10^{-9}$ to $10^{-5}$ mole per mole of silver.

14. A method according to claim 13 wherein the class (i) dopant satisfies the formula:

$$[ML_4(NY)L']^n \quad \text{(I)}$$

wherein

M is a transition metal chosen from groups 5 to 10 inclusive of the periodic table of elements;

L' is L or (NY);

L is a bridging ligand, which can be independently selected in each occurrence, and is anionic in at least four occurrences;

Y is oxygen or sulfur; and n is zero, −1, −2 or −3;

the class (ii) dopant which satisfies the formula:

$$[ML_6]^n \quad \text{(II)}$$

wherein

M is a filled frontier orbital polyvalent metal ion;

$L_6$ represents bridging ligands which can be independently selected, provided that at least four of the ligands are anionic ligands, and at least one of the ligands is a cyano ligand or a ligand more electronegative than a cyano ligand; n is the net charge; and the class (iii) dopant satisfies the formula:

$$[IrL_6]^n \quad \text{(III)}$$

wherein n is zero, −1, −2, −3 or −4; and $L_6$ represents six bridging ligands which can be independently selected, provided that at least four of the ligands are anionic ligands and each of the ligands is more electropositive than a cyano ligand.

15. A method according to claim 14 wherein the class (i) dopant is present in a concentration of from $10^{-9}$ to $10^{-7}$ mole per silver mole.

16. A method according to claim 15 wherein the class (i) dopant satisfies the formula:

$$[M'L''_5(NY)]^n \quad \text{(Ia)}$$

wherein

M' represents chromium, rhenium, ruthenium or osmium;

L" represents one or a combination of halide and cyano ligands or a combination of these ligands with an aquo ligand;

Y is oxygen or sulfur; and n is zero, −1, −2 or −3.

17. A method according to claim 16 wherein M' represents ruthenium or osmium.

18. A method according to claim 14 wherein the bridging ligands of the class (ii) dopant are at least as electronegative as cyano ligands.

19. A method according to claim 18 wherein the class (ii) dopant is present in a concentration of from $10^{-6}$ to $5\times10^{-4}$ mole per silver mole.

20. A method according to claim 14 wherein the (iii) dopant is an iridium coordination complex containing six halide ligands.

21. A method according to claim 20 wherein the class (iii) dopant is present in a concentration from $10^{-7}$ to $10^{-9}$ mole per silver mole.

22. A method according to claim 14 wherein the class (i) dopant is present in a central region accounting for at least 50 percent of each of the grains, the class (ii) dopant is present in an interior shell surrounding from 75 to 95 percent of the silver forming each of the grains, and the class (iii) dopant is present in an interior shell surrounding at least 85 percent of the silver forming each of the grains.

23. A method according to claim 1 wherein the central portion accounts for from 95 to 97 percent of silver forming each of the grains.

24. A method according to claim 23 wherein the central region accounts for 95 percent of silver forming each of the grains.

25. A method according to claim 1 wherein the recording element contains a yellow, magenta or cyan dye-forming coupler and is exposed to a portion of the infrared region of the spectrum by a laser source to produce a dye image on processing.

26. An electronic printing method which comprises subjecting a recording element comprised of a white, reflective or translucent support and, coated thereon, a red-sensitized silver halide emulsion layer unit containing a cyan dye-forming coupler, a green-sensitized silver halide emulsion layer unit containing a magenta dye-forming coupler, and a blue-sensitized silver halide emulsion layer unit containing a yellow dye-forming coupler to actinic radiation of at least $10^{-4}$ ergs/cm$^2$ for up to 100μ seconds duration in a pixel-by-pixel mode, wherein at least one of the silver halide emulsion layers is comprised of (1) silver halide grains (a) containing greater than 90 mole percent chloride and less than 5 mole percent iodide, based on silver, (b) having greater than 50 percent of their surface area provided by {100} crystal faces, and (c) having a central portion accounting for from 95 to 98 percent of total silver and containing three dopants each selected to satisfy a different one of the following class requirement:

(i) confined to the central portion of the grains in a concentration of from $10^{-9}$ to $10^{-7}$ mole per silver mole, based on total silver, a ruthenium or osmium coordination complex containing a nitrosyl or thionitrosyl ligand;

(ii) located in an interior shell which surrounds at least 50 percent of total silver in a concentration of from $10^{-6}$ to $5\times10^{-4}$ mole per silver mole, based on total silver, a shallow electron trapping dopant which satisfies the formula:

$$[ML_6]^n \quad \text{(II)}$$

wherein

M is a filled frontier orbital polyvalent metal ion;

$L_6$ represents bridging ligands which can be independently selected, provided that at least four of the ligands are anionic ligands, and at least three of the ligands is a cyano ligand or a ligand more electronegative than a cyano ligand; n is the net charge; and (iii) located in an interior shell that surrounds at least 85 percent of total silver in a concentration of from $10^{-9}$ to $10^{-7}$ mole per silver mole, based on total silver, an iridium hexacoordination complex containing six halide ligands, and (2) a gelatino-peptizer for the silver halide grains that contains less than 5 micromoles of methionine per gram.

27. A method according to claim 26 wherein the silver halide grains are silver iodochloride grains containing from 0.5 to 3.0 mole percent iodide, based on silver.

28. A method according to claim 26 wherein greater than 50 percent of total projected area of the silver halide grains is accounted for by tabular grains.

29. A method according to claim 26 wherein the silver halide grains contain at least 90 mole percent chloride and less than 1 mole percent iodide, based on silver.

* * * * *